United States Patent [19]

Messer

[11] 4,367,879

[45] Jan. 11, 1983

[54] GOLF TEE WITH HOLDING CUP WITH SPIN CONTROL MEMBER

[76] Inventor: Steve Messer, 1325 Washington Ct., Brookfield, Wis. 53005

[21] Appl. No.: 215,511

[22] Filed: Dec. 11, 1980

[51] Int. Cl.[3] ..... A63B 57/00

[52] U.S. Cl. ..... 273/211; 273/33; 273/207

[58] Field of Search ..... 273/211, 33, 207, 206, 273/203, 208

[56] References Cited

U.S. PATENT DOCUMENTS

| | | | |
|---|---|---|---|
| 2,033,269 | 3/1936 | Williams | 273/33 |
| 3,288,470 | 11/1966 | Post | 273/211 |
| 3,414,268 | 2/1978 | Chase | 273/211 |
| 3,473,812 | 10/1969 | Pelzmann | 273/211 |
| 3,506,263 | 3/1970 | Arrington | 273/33 |

*Primary Examiner*—Richard C. Pinkham
*Assistant Examiner*—T. Brown
*Attorney, Agent, or Firm*—Brown & Martin

[57] ABSTRACT

A golf ball spin control tee is constructed with a stem for anchoring in the ground and a head having arms for partially encircling the ball and frictionally engaging the surface of the ball for affecting the spin of the ball when struck by a golf club.

6 Claims, 5 Drawing Figures

GOLF TEE WITH HOLDING CUP WITH SPIN CONTROL MEMBER

BACKGROUND OF THE INVENTION

The present invention relates to golf tees and pertains particularly to a spin control tee.

The trajectory of a golf ball when propelled by the impact of a club of a tee is affected by the spin of the ball. The spin of the ball will be determined by how the ball is struck by the club face. If the club face is moving along a path or straight line perpendicular to the club face upon impact with the ball, the ball will tend to have a straight trajectory or will move in a straight line along the path of the club. However, should the club be moving across the line perpendicular to the club face upon impact, a horizontal spin, that is a spin in a horizontal plane will be imparted to the ball. This will cause either a hook or a slice of the ball, depending upon the direction of movement of the club face upon impact with the ball.

While the inadvertent hooking or slicing of the ball is best corrected by training and developing the skill of the player, other means have been suggested for correcting this problem for unskilled players. One of the prior art approaches to this problem is the provision of a tee having a shield or guard which is struck first by the ball such that a considerably lesser amount of the spin is imparted to the ball when improperly struck by the club. Examples of the approaches of others toward solving this problem are shown for example in the following U.S. patents:

U.S. Pat. No. 2,033,269 issued 3/10/36 to C. R. Williams.

U.S. Pat. No. 3,506,263 issued 4/14/70 to G. M. Arrington.

These patents both disclose some form of shield or cup that extends upward or supports the ball on a tee and shields the ball from the impact of the club. While these proposed constructions do make a measurable difference in the spin imparted to the ball, they do not in most cases completely eliminate it. It is also desirable that vertical spin, that is, spin in a plane along the vertical axis also be controlled to some degree independent of the club face.

It is therefore desirable that some means be available which controls the spin of a golf ball independently of the impact of a club face on the ball.

SUMMARY AND OBJECTS OF THE INVENTION

It is therefore the primary object of the present invention to overcome the above problems of the prior art.

Another object of the invention is to provide means for controlling the spin of a golf ball.

A further object of the invention is to provide an improved golf tee having means for controlling the spin of a golf ball.

In accordance with the primary aspect of the present invention a golf ball tee is provided with friction arm means partially encircling and frictionally gripping a golf ball for controlling the spin thereof.

DETAILED DESCRIPTION OF PREFERRED EMBODIMENTS

Figure 1:
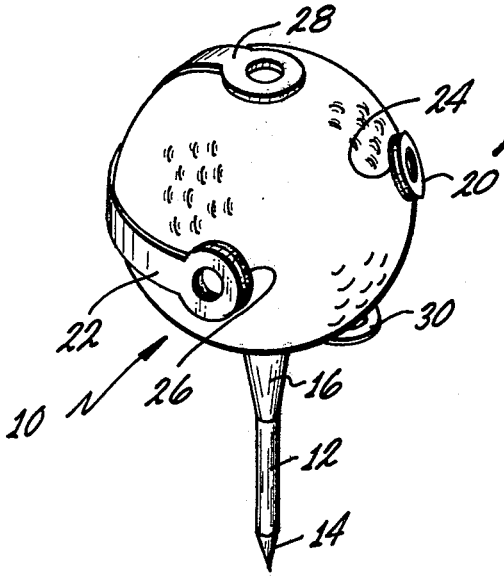
Turning to FIG. 1 of the drawing there is illustrated a perspective view of a golf tee in accordance with the invention.

Turning now to FIG. 1 of the drawing there is illustrated a tee designated generally by the numeral 10 constructed in accordance with the preferred embodiment of the invention. The tee 10 includes a shaft or shank portion 12 having a lower sharpened point 14 for insertion into the ground for support thereof and a head portion 16 having a cup like depression for supporting a golf ball. Extending upward from the cup portion or head of the golf tee is a shield or cup like portion 18 which partially shields a portion of the golf ball against impact by the face of the club. Extending to each side and partially encircling the golf ball to each side are a pair of arms 20 and 22, each of which may include preferably at the forward tip, friction means for frictionally engaging the ball. The friction means may be in the form of separate friction pads 24 and 26 on the end of the fingers of arm members which engage and grip the surface of a golf ball 28.

Figure 2:
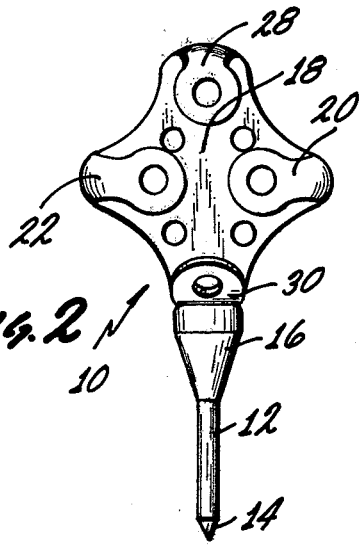
FIG. 2 illustrates a front elevational view of the embodiment of FIG. 1.
Figure 3:
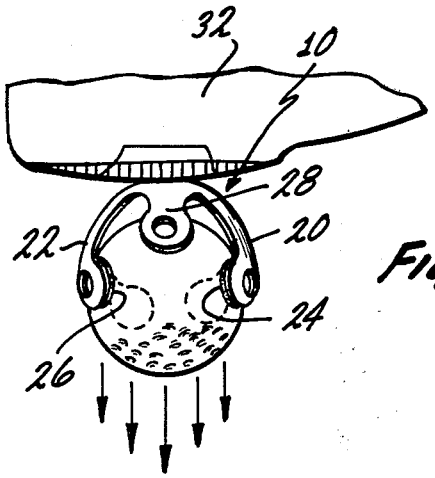
FIG. 3 illustrates a top plan view of the embodiment of FIG. 1.

With the embodiment as illustrated in FIG. 1 and 2, it will be appreciated that when a golf ball disposed within and supported on the described tee is properly struck by means of a club such as a driver or the like, the head of the club will first strike the shield or cup portion and the impact thereof will travel through the cup or shield portion into the ball propelling the ball from the tee as shown in FIG. 3. The shield will substantially reduce the spin imparted to the ball by the club and any tendency to spin will be further reduced by the friction means in the arms or fingers extending around both sides of the ball. While the arms or fingers will naturally provide a drag that will reduce the distance or range of the shot, such drag has been found to have a minor effect on the range. THe accuracy of the shot improved by the subject device far outweighs the inaccuracy of the hooked or sliced shots by the unskilled player. This will somewhat reduce the frustrations of playing by the unskilled player. An overreaching arm 28 extending over the top of the golf ball can be designed to impart a vertical spin (i.e. in the vertical plane) to the ball. The degree of the spin can be controlled by means of a friction pad on the tip of finger 28. A lower support finger or arm 30 extends beneath the ball, and can also be used to impart a spin thereto. Club 32 is shown striking the ball in FIG. 3.

While the device of the present invention will probably not be permitted in tournaments, it will, as pointed out above, reduce the frustrations of the drafter or unskilled. Therefore it can greatly aid the non-professional in his enjoyment of the game.

Figure 4:
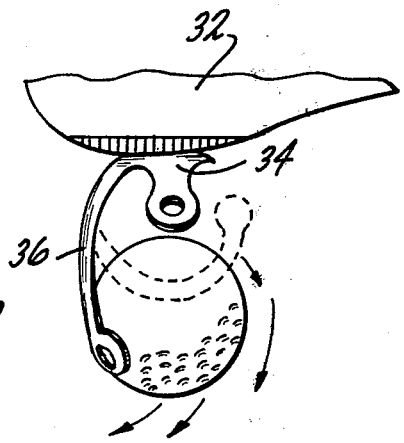
FIG. 4 is a top plan view of an alternate embodiment.

Turning to FIG. 4 of the drawings there is illustrated an embodiment which is designed to impart a specific horizontal spin to the ball. This construction is such as to impart a specific horizontal spin, that is spin in the horizontal plane, to the ball and deliberately impart a hook or slice to the ball as desired. As will be appreciated it is desirable in many instances to specifically impart a controlled spin, such as a hook or slice, to a ball during play. For the unskilled player, this is difficult to do in a manner to impart any reasonable control on the ball. For this reason a construction as shown in FIG. 4 wherein a cup 34 having a single friction arm 36 extending around one side of the ball and frictionally engaging the one side of the ball will impart to the ball a predetermined control spin on the ball when struck by a driver or other club. The degree of spin can be controlled by the degree of stiffness in the arm, its length and the extent of any friction pads used.

Figure 5:
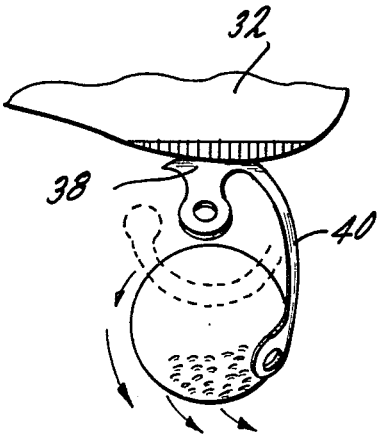
FIG. 5 is a top plan view of a still further embodiment of the invention.

As will be appreciated from FIG. 5, this single arm can extend to either side of the ball and thus effect or establish either a hook or a slice as desired on the ball. In FIG. 5 a cap 38 includes an arm 40 to impart a counterclockwise spin to the ball.

The construction can also be modified to impart a vertical spin that is a spin in a vertical plane, on the ball for either imparting a controlled back spin on the ball, or for imparting a forward spin as desired. A back spin on the ball will cause the ball to stop rather quickly when it strikes the ground. On the other hand, a top spin on the ball will cause the ball to roll forward a substantial distance after striking the ground thus obtaining increased range. These can be controlled by the degree of frictional engagement imparted to the ball by either finger 28 or 30 of the FIG. 1 through 3 embodiment.

Thus, the constructions of a tee in accordance with the invention are designed to impart a spin of a controlled nature on a ball and thus affect the trajectory of the ball.

While I have illustrated and described my invention by means of specific embodiments it is to be understood that numerous changes and modifications may be made therein without departing from the spirit and scope of the invention as defined in the appended claims.

I claim:

1. A golf ball spin control tee comprising:

an elongated ground engaging stem having an anchoring point at the lower end and a ball supporting head on the upper end including a shield extending upward from said supporting head and having a semispherical portion for engaging the back surface of a ball and to be struck by a golf club for imparting an impelling force to the ball, and elongated arm means extending from and supported by said shield for partially encircling and extending to and terminating in an outer end at a position at the front opposite said shield of a ball resting on said head, and said arm means including friction means at the outer end thereof for frictionally engaging the surface of the ball for affecting the spin of the ball when struck and propelled from said tee by a golf club.

2. The spin control tee of claim 1 wherein said arm means comprises a pair of arms, each arm extending around an opposite side of the ball for reducing the horizontal spin thereof.

3. The spin control tee of claim 1 wherein said arm means comprises a single arm extending around one side of the ball for imparting a horizontal spin to said ball.

4. The spin control tee of claim 3 wherein said single arm extends around the left side of the ball for imparting a horizontal spin to the ball.

5. The spin control tee of claim 3 wherein said single arm extends around the right side of the ball.

6. The spin control tee of claim 1 wherein said arm means comprises a single arm extending over the top of the ball for inducing a vertical spin on said ball.

* * * * *